US007905755B1

(12) United States Patent
Martauz

(10) Patent No.: US 7,905,755 B1
(45) Date of Patent: Mar. 15, 2011

(54) ELECTRICAL TERMINAL CONNECTION WITH SEALED CORE CRIMP

(75) Inventor: Francis D. Martauz, Canfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/575,689

(22) Filed: Oct. 8, 2009

Related U.S. Application Data

(60) Provisional application No. 61/243,672, filed on Sep. 18, 2009.

(51) Int. Cl.
*H01R 4/10* (2006.01)

(52) U.S. Cl. ..... 439/877; 439/878; 439/886; 205/118; 205/133

(58) Field of Classification Search ..... 439/877, 439/878, 886; 205/118, 133
See application file for complete search history.

(56) References Cited

U.S. PATENT DOCUMENTS 3,805,221 A * 4/1974 Kuo ..... 439/877
3,956,823 A * 5/1976 Kuo ..... 439/877
4,641,911 A * 2/1987 Pavlak et al. ..... 439/877
5,225,066 A * 7/1993 Drew ..... 205/85
5,445,535 A * 8/1995 Phillips et al. ..... 439/394
5,536,186 A 7/1996 Wantanabe
5,868,590 A 2/1999 Dobbelaere
5,980,318 A 11/1999 Morello et al.
6,257,931 B1 7/2001 Sakurai et al.
6,322,401 B2 11/2001 Suzuki
6,354,873 B1 3/2002 Morello et al.
6,375,502 B2 4/2002 Yoshida et al.
6,869,312 B2 3/2005 Hasebe
7,121,903 B2 * 10/2006 Sakaguchi et al. ..... 439/877
7,160,150 B2 1/2007 Annequin
7,207,841 B2 4/2007 Machida et al.
7,238,884 B2 * 7/2007 Tanaka et al. ..... 174/74 R
7,371,132 B2 5/2008 Tanaka
7,422,480 B1 9/2008 Musick et al.
7,438,585 B2 10/2008 Morello
2002/0076996 A1 6/2002 Murakami et al.
2010/0084159 A1 * 4/2010 Drew et al. ..... 174/113 R

* cited by examiner

*Primary Examiner* — Tho D Ta
(74) *Attorney, Agent, or Firm* — Thomas N. Twomey

(57) ABSTRACT

A corrosion resistant electrical connection structure has an electrically conductive cable with a core made from a first electrically conductive material and an insulative outer cover. A terminal is electrically connected to the core at a lead extending beyond the insulative outer cover. A conformal coating covers and seals the lead of the core not in direct contact with the terminal.

12 Claims, 2 Drawing Sheets

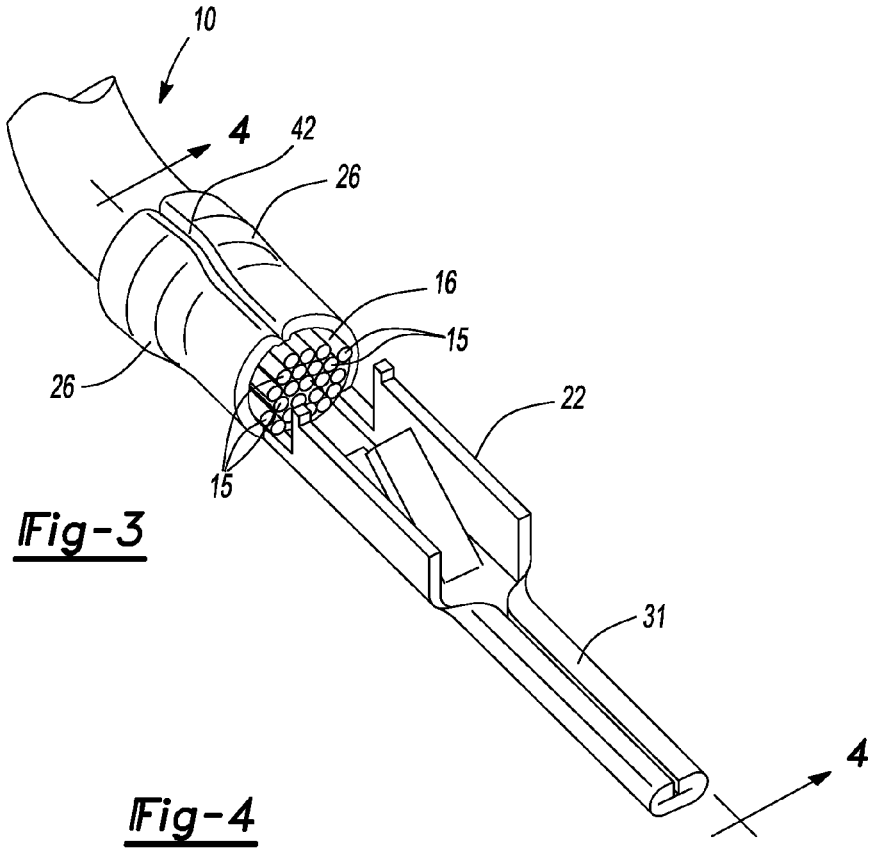
Fig-3
Fig-4
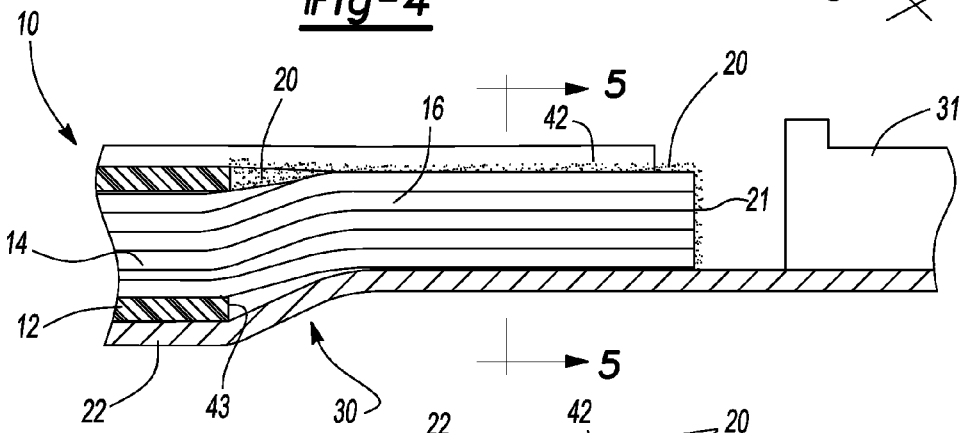
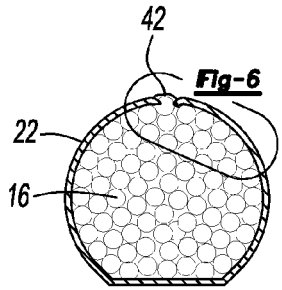
Fig-5
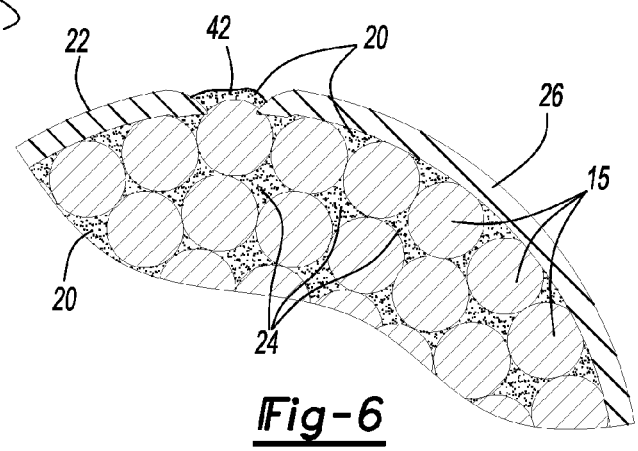
Fig-6

ELECTRICAL TERMINAL CONNECTION WITH SEALED CORE CRIMP

CROSS-REFERENCE TO CLAIM OF PRIORITY

This application claims the priority of co-pending U.S. Provisional Application Ser. No. 61/243,672 filed Sep. 18, 2009.

TECHNICAL FIELD

The field of this invention relates to a connection between an aluminum based cable and a copper based electrical terminal.

BACKGROUND OF THE DISCLOSURE

Insulated copper based cable is commonly used for automotive wiring. Copper has high conductivity, good corrosion resistance and adequate mechanical strength. However, copper and copper based metals are relatively expensive metals and are also heavy.

Interest is weight savings and cost savings in automotive electrical wiring applications have made aluminum based cables an attractive alternative to copper based wires. However, some wiring and electrical connectors may remain copper based. Thus, there may be a transition somewhere in the electrical circuit between an aluminum based portion of the circuit and a copper based portion of the circuit. Often this transition may occur at the terminal because the terminal may remain copper based for reasons of size and complexity of shape that can be more easily achieved with copper based materials over aluminum based materials. The connection of aluminum based cable to a copper based terminal can produce a galvanic corrosion of the aluminum, if an electrolyte, for example salt water, is present. The galvanic reaction corrodes the aluminum because the aluminum or aluminum alloy has a different galvanic potential than the copper or copper alloys of the terminals. "Copper based" as used in this document means pure copper, or a copper alloy where copper is the main metal in the alloy. Similarly, "aluminum based" as used in this document means pure aluminum or an aluminum alloy where aluminum is a main metal in the alloy.

Referring now to FIG. 1, significant corrosion is known to occur between dissimilar materials when an electrolyte such as salt water is present. A conventional copper based terminal 35 as shown in FIG. 1 has a pair of insulator wings 36 and a pair of core wings 38 with a notch 40 therebetween. A stranded aluminum based cable 12 may have its connected exposed strand ends 15 of lead 16 substantially corrode when it is attached to a terminal 35 made from a more noble metal such as pure copper, brass, or another copper alloy. A four day long salt fog test has been demonstrated to substantially corrode away almost the entire aluminum lead 16. The notch 40 allows greater access of the salt and other electrolytes to contact the exposed strands 15. The lead 16 when corroded completely away causes a break in the electrical connection between the cable 12 and the terminal 35.

What is needed is an improved corrosion resistant connection between a cable and its connected terminal. What is also needed is a connection between aluminum based cable and copper based terminals with improved corrosion resistance through an improved seal to seal the aluminum cable from an electrolyte while maintaining electrical contact with the terminal.

SUMMARY OF THE DISCLOSURE

In accordance with one aspect of the invention, an electrical connection structure has a conductive cable with a core being aluminum based and an insulative outer cover. A terminal is copper based and electrically attached to the core. The terminal has a mating end and an opposite end with a first combination insulation and core wing. The combination insulation and core wing is crimped onto the insulative outer cover, spans over an edge of the insulative outer cover of the conductive cable, and is crimped onto and makes electrical contact with a lead of the core that axially extends beyond the insulative outer cover. A cured conformal coating is over remaining portions of the lead of the core that is not in direct contact with the terminal.

Preferably, the terminal has a second combination insulation and core wing at the opposite end for also being crimped onto the insulative outer cover, spanning over the edge of the insulative outer cover and crimped onto and making electrical contact with the lead of the core. The first and second combination insulator and core wings are crimped toward each other about the lead of the cable. In one embodiment, a narrow gap is formed between the first and second insulator and core wings. The gap is filled with the cured conformal coating. The core is a plurality of strands that when crimped has voids which are filled with the cured conformal coating.

In accordance with another aspect of the invention, an electrical terminal has a body with a mating end. The body has an opposite end with a combination insulation and core wing for crimping onto the insulative outer cover of each cable, spanning over an edge of an insulative outer cover of the cable and crimped onto and making electrical contact with the lead of the core extending beyond the insulative outer cover.

Preferably, the terminal has a second combination insulation and core wing at the opposite end for also being crimped onto the insulative outer cover, spanning over the edge of the insulative outer cover and crimped onto and making electrical contact with the lead of the core.

In accordance with another aspect of the invention, a corrosion resistant electrical connection structure has an electrically conductive cable having a core made from a first electrically conductive material and an outer insulative cover. A terminal is electrically connected to the core at a lead extending beyond the outer insulative cover. The terminal is made of a second electrically conductive material that is more electropositive than the first electrically conductive material when exposed to an electrolytic environment. A conformal coating covers and seals the lead of the core not in direct contact with the terminal.

Preferably, the terminal has a mating end. The terminal has an opposite end with a combination insulation and core wing for crimping onto a lead of a conductive core of the cable. The combination insulation and core wing is crimped onto the insulative outer cover, spans over an edge of an insulative outer cover of the cable, and is crimped onto and makes electrical contact with the lead of the core extending beyond the insulative outer cover.

In accordance with another aspect of the invention, an electrical connection structure has a cable with an electrically conductive core and an insulative outer cover. An electrically conductive terminal is electrically connected to the core at a lead of the core extending beyond the insulative outer cover. The terminal has a mating end and an opposite end with a combination insulation and core wing for crimping onto a lead of a conductive core of the cable. The combination insulation and core wing is crimped onto the insulative outer cover spanning over an edge of an insulative outer cover of the cable, and crimped onto and making electrical contact with the lead of the core extending beyond the insulative cover. The terminal preferably has a second combination insulation and core wing at the opposite end for also being crimped onto the insulative outer cover, spanning over the edge of the insulative outer cover and crimped onto and making electrical contact with the lead of the core. A conformal coating covers and seals the lead of the core not in direct contact with the terminal.

BRIEF DESCRIPTION OF THE DRAWINGS

Reference now is made to the accompanying drawings in which:

FIG. 3 is a perspective view of the terminal and the aluminum based cable assembled onto the terminal;

FIG. 4 is a cross-sectional view taken along lines 4-4 shown in FIG. 3; and FIG. 5 is a cross-sectional view taken along lines 5-5 shown in FIG. 4.

FIG. 6 is a magnified view of the aluminum based cable as indicated in FIG. 5.

DETAILED DESCRIPTION OF THE PREFERRED EMBODIMENT

Figure 2:
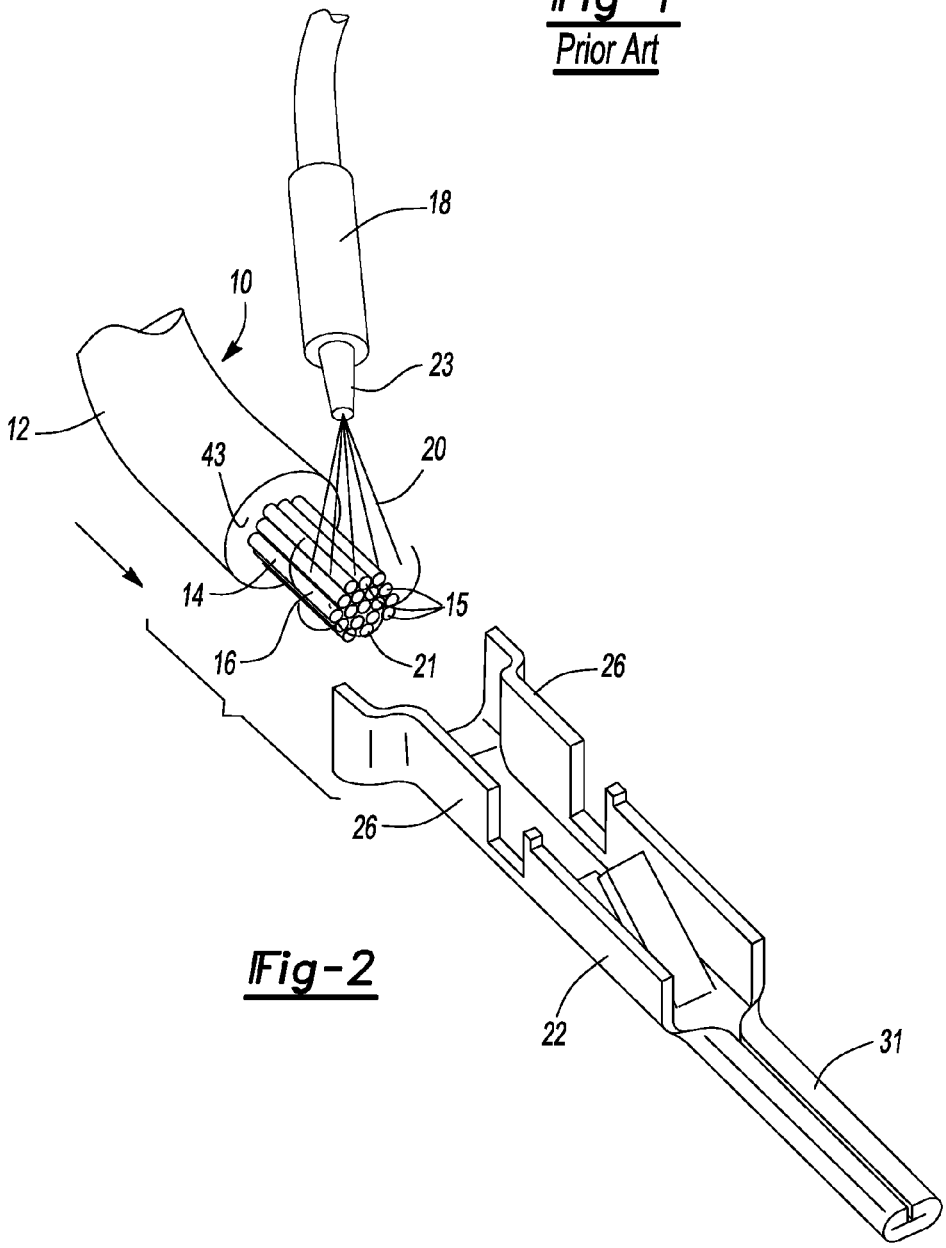
FIG. 2 is a perspective and exploded view of copper based terminal and the treated cable of FIG. 2 an aluminum based cable with its end being removed of its insulative outer cover and undergoing a spray of conformal coating in the axial direction toward the exposed end of the conductive cable core in accordance with one embodiment of the invention before assembly.

Referring to FIG. 2, a cable 10 has an insulative outer cover 12 and an aluminum based core 14. The core 14 is made of a plurality of individual strands 15 bundled and twisted together. An end portion of the insulative outer cover 12 is removed to expose a lead 16 of the core 14. A spray machine 18 sprays a conformal coating 20 onto the lead 16 of the core. The position of the spray head 23 is pointed to be directed away from cover 12 and toward the axial distal end 21 of the lead 16. The direction of the spray is axially directed away from the insulative outer cover 12 and toward the axial distal end 21. The spray head 23 may commence spraying the conformal coating 20 before the cable is moved into the spray of conformal coating 20. The cable is then moved axially into the spray such that axial ends 21 hit the spray and is coated with conformal coating 20. The cable may rotate or the spray head 18 may orbit about the cable 12 to assure the lead 16 is coated 360° around. As the cable is moved forward toward terminal 22, the spray head 23 may be axially aligned with the insulative outer cover 12 and provide conformal coating 20 over edge 43 of insulative outer cover 12. The entire lead 16 is coated.

While the conformal coating is still wet, the cable 10 is positioned relative to a terminal 22 as best shown in FIG. 3. The terminal 22 has a mating end 31. The terminal 22 is then crimped at its opposite end onto the cable 10 such that it makes electrical contact with the lead 16 of core 14 at best shown in FIGS. 4, 5 and 6.

As the terminal is crimped onto the cable 10, the conformal coating 20 on the lead 16 is displaced to allow direct contact between the terminal 22 and the lead 16. The conformal coating is displaced to fill voids 24 between the strands 15 as highlighted in FIG. 6, and other exposed surfaces of the lead 16 that are not in direct contact with the terminal 22, for example in an area 42 between the wings 26 and at the end 21 as best shown in FIG. 4. After the crimping of the terminal 22 onto the cable 10, the conformal coating is allowed to cure to complete the assembly of the electrical connection 30.

Figure 1:
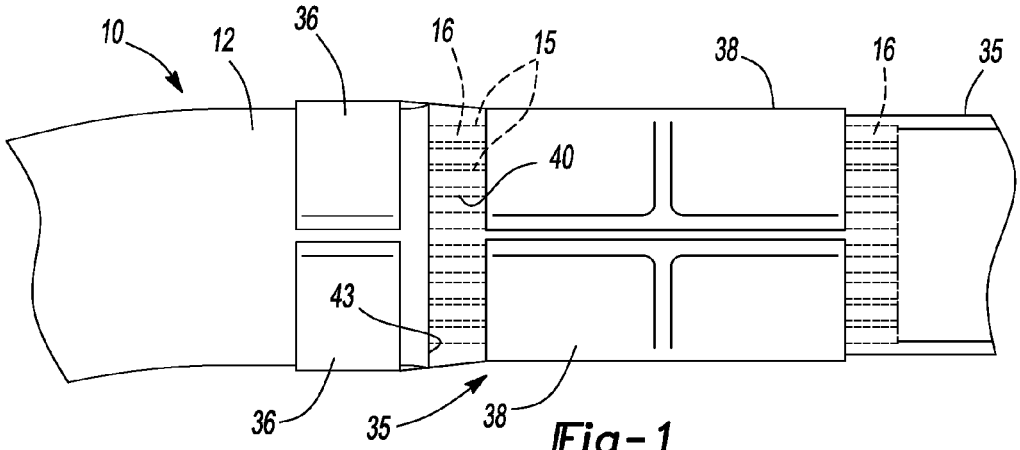
Fig-1 Prior Art
FIG. 1 is a plan view of a conventional prior art aluminum based cable and copper based terminal illustrating the exposed strand ends of the aluminum based wire in phantom that have been substantially corroded away.

The terminal 22 has wings 26 that eliminate the conventional notch 40 shown in FIG. 1. The wings 26 are crimped over the insulative outer cover 12 and span over an edge 43 of the insulative outer cover 12 and are crimped onto the lead 16. The wings 26 can be referred to as combination insulator and core wings.

Each wing 26 is crimped onto the lead 16 while the conformal coating 20 is still wet. The conformal coating 20 is displaced from the abutting surfaces of the terminal 22 and lead 16 to provide an electrical interface and connection between the terminal 22 and lead 16. The conformal coating 20 is displaced to areas of the lead 16 that are not in direct contact with the terminal, for example within the gap 42 formed between the crimped wings 26 and within the voids 24 and at the axial outer end 21 of the lead 16.

The conformal coating 20 is then cured in position to complete the electrical assembly 30.

By sealing the electrical connection from electrolyte such as salt water, significant reduction of galvanic corrosion occurs between aluminum based cable and copper based electrical terminals. The displacement of the conformal coating 20 while it is still wet greatly enhances the structural sealing of the entire lead and aluminum based core while providing a sealed electrical interface and contact between the terminal and lead. The combination insulator and core wing also reduces exposure of the lead to the elements that can otherwise increase risk of electrolytic corrosion.

While the main application of this invention is for an interface between to two dissimilar metals, it is foreseen that application of this seal can also provide advantages for an interface between a terminal and lead interface made from similar or identical metals.

Other variations and modifications are possible without departing from the scope and spirit of the present invention as defined by the appended claims.

The embodiments in which an exclusive property or privilege is claimed are defined as follows:

1. An electrical connection structure comprising:

a conductive cable having a core being aluminum based and an insulative outer cover;

a terminal being copper based and electrically attached to said core;

said terminal including a base and having a mating end;

said terminal having an opposite end having a first wing defined as a first combination insulation and core wing, said first wing being a wall extending from said base and being formed of a single unitary piece;

said wall being crimped onto the insulative outer cover, spanning over an edge of said insulative outer cover of said conductive cable, and crimped onto and making electrical contact with a lead of said core that axially extends beyond said insulative outer cover so that said wall encloses said lead and said insulative outer cover adjacent said lead; and a cured conformal coating covering over remaining portions of said lead of said core not in direct contact with said terminal.

2. The electrical connection structure as defined in claim 1 further comprising:

said terminal having a second wing defined as a second combination insulation and core wing at said opposite end, said second wing being a wall extending from said base and being formed of a single unitary piece, said second wing being crimped onto the insulative outer cover, spanning over said edge of said insulative outer cover and crimped onto and making electrical contact with said lead of said core so that said wall of said second wing encloses said lead and said insulative outer cover adjacent said lead.

3. The electrical connection structure as defined in claim 2 further comprising:

said first and second combination insulator and core wings being crimped toward each other about said lead of said cable.

4. The electrical connection as defined in claim 3 further comprising:

a narrow gap formed between said first and second insulator and core wings which is filled with said cured conformal coating.

5. The electrical connection structure as defined in claim 4 further comprising:

said core being a plurality of strands that when crimped has voids which are filled with said cured conformal coating.

6. An electrical terminal comprising:

a body including a base and having a mating end; and said body having an opposite end with a first wing defined as a first combination insulation and core wing, said first wing being a wall extending from said base and formed of a single unitary piece for crimping onto an insulative outer cover of a cable and for spanning over an edge of the insulative outer cover of said cable, and crimping onto and making electrical contact with a lead of said core extending beyond said insulative outer cover, said wall enclosing said lead and said insulative outer cover adjacent said lead.

7. The electrical terminal as defined in claim 6 further comprising:

said terminal having a second wing defined as a second combination insulation and core wing at said opposite end for also being crimped onto the insulative outer cover, spanning over said edge of said insulative outer cover and crimped onto and making electrical contact with said lead of said core, said second wing being a wall extending from said base and formed of a single unitary piece, said wall enclosing said lead and said insulative outer cover adjacent said lead; and said body being copper based.

8. A corrosion resistant electrical connection structure comprising:

an electrically conductive cable having a core made from a first electrically conductive material and an insulative outer cover;

a terminal electrically connected to the core at a lead extending beyond said insulative outer cover where a first wing is defined as a first combination and core wing of the terminal, and said first wing is a wall extending from a base of said terminal and the wall is formed of a single unitary piece, and said wall is crimped to said cable so that the wall encloses said lead and said insulative outer cover adjacent said lead;

the terminal being made of a second electrically conductive material that is more electro-positive than the first electrically conductive material when exposed to an electrolytic environment; and a cured conformal coating covering and sealing said lead of said core not in direct contact with said terminal.

9. The corrosion resistant electrical connection as defined in claim 8 further comprising:

said terminal having a mating end;

said terminal having an opposite end with a combination insulation and core wing for crimping onto a lead of a conductive core of said cable; and said combination insulation and core wing crimped onto the insulative outer cover, spanning over an edge of an insulative outer cover of said cable, and crimped onto and making electrical contact with said lead of said core extending beyond said insulative outer cover.

10. The corrosion resistant electrical connection as defined in claim 8 further comprising:

said terminal having a second wing defined as a second combination insulation and core wing at said opposite end, said second wing being a wall extending from said base and being formed of a single unitary piece, said second wing being crimped onto the insulative outer cover, spanning over said edge of said insulative outer cover and crimped onto and making electrical contact with said lead of said core, said wall of said second wing enclosing said lead and said insulative outer cover adjacent said lead.

11. An electrical connection structure comprising:

a cable having an electrically conductive core and an insulative outer cover;

a terminal electrically connected to the core at a lead of said core extending beyond said insulative outer cover;

the terminal being made of electrically conductive material;

said terminal including a base and having a mating end;

said terminal having an opposite end with a first wing defined as a combination insulation and core wing for crimping onto a lead of a conductive core of said cable, said first wing being a wall extending from said base and being formed of a single unitary piece;

said first wing being crimped onto the insulative outer cover spanning over an edge of an insulative outer cover of said cable, and crimped onto and making electrical contact with said lead of said core extending beyond said insulative outer cover, and said wall enclosing said lead and said insulative outer cover adjacent said lead; and a cured conformal coating covering and sealing said lead of said core not in direct contact with said terminal.

12. The corrosion resistant electrical connection as defined in claim 11 further comprising:

said terminal having a second wing defined as a second combination insulation and core wing at said opposite end, said second wing being a wall extending from said base and being formed of a single unitary piece, said second wing being crimped onto the insulative outer cover, spanning over said edge of said insulative outer cover and crimped onto and making electrical contact with said lead of said core, said wall of said second wing enclosing said lead and said insulative outer cover adjacent said lead.

* * * * *